US006676768B2

(12) United States Patent
Fillipi et al.

(10) Patent No.: US 6,676,768 B2
(45) Date of Patent: Jan. 13, 2004

(54) METHODS, COMPOSITIONS AND APPARATUS FOR CLEANING SURFACES

(75) Inventors: Gregory M. Fillipi, Norman, OK (US); Bobby E. Walls, Drumright, OK (US); Anthony K. Magerus, Nicoma Park, OK (US); Jerry L. Gore, Midwest City, OK (US); Jerome B. Strauss, Annandale, VA (US); Gerard K. Newman, Norman, OK (US); Jan Goldberg, Heath, OH (US); Christy Crowe, Heath, OH (US)

(73) Assignee: Versar, Inc., Springfield, VA (US)

( * ) Notice: Subject to any disclaimer, the term of this patent is extended or adjusted under 35 U.S.C. 154(b) by 0 days.

(21) Appl. No.: 10/207,227

(22) Filed: Jul. 30, 2002

(65) Prior Publication Data

US 2002/0179117 A1 Dec. 5, 2002

Related U.S. Application Data

(63) Continuation of application No. 09/775,641, filed on Feb. 5, 2001, now abandoned.

(60) Provisional application No. 60/180,175, filed on Feb. 4, 2000, provisional application No. 60/185,691, filed on Feb. 29, 2000, and provisional application No. 60/187,866, filed on Mar. 8, 2000.

(51) Int. Cl.[7] ..... B08B 9/00

(52) U.S. Cl. ..... 134/18; 134/19; 134/22.1; 134/22.11; 134/22.12; 134/22.14; 134/22.19; 134/26; 134/30; 134/34; 134/35; 134/36; 134/37; 134/40; 134/42; 134/113; 134/95.2; 134/95.1; 134/169 C; 134/169 R; 73/61.71; 73/28.01; 510/412; 510/421; 422/124; 422/125; 422/126

(58) Field of Search ..... 134/18, 19, 22.1, 134/22.11, 22.12, 22.14, 22.19, 26.3, 34, 35, 36, 37, 40, 42, 113, 95.2, 95.1, 169 C, 169 R; 73/61.71, 28.01; 510/412, 421; 422/124, 125, 126

(56) References Cited

U.S. PATENT DOCUMENTS 4,587,032 A 5/1986 Rogers ..... 252/174.17

(List continued on next page.)

FOREIGN PATENT DOCUMENTS

GB 2261364 5/1993

OTHER PUBLICATIONS

"A Novel Method and Apparatus for Cleaning Oxygen Service Equipment Via a Surfactant–Enhanced Fluorocarbon Solvent", Crowe, Christy L., A thesis submitted to the Graduate School in partial fulfillment of the requirements for the Degree Master of Science in Chemical Engineering, New Mexico State Unviersity, Les Cruces, New Mexico, Dec., 1999.

(List continued on next page.)

*Primary Examiner*—Sharidan Carrillo
(74) *Attorney, Agent, or Firm*—Bacon & Thomas, PLLC

(57) ABSTRACT

The present invention comprises methods, compositions and apparatus for cleaning the surfaces within vessels that have restricted points of entry, and in particular, the surfaces within oxygen converters and oxygen cylinders. These oxygen converters and oxygen cylinders are components of the onboard oxygen supply systems of aircraft. A surfactant and a solvent are mixed to form a cleaning composition that is boiled at reduced pressure and increased temperature within the oxygen converter or oxygen cylinder. The oxygen converter or oxygen cylinder is rinsed with pure solvent, and the rinse fluid is measured to determine the level of contaminants. Dry air is forced through the oxygen converter or oxygen cylinder to remove remaining solvent. The cleaning composition may comprise a fluorocarbon solvent and a fluorosurfactant.

20 Claims, 1 Drawing Sheet

U.S. PATENT DOCUMENTS

| | | | | |
|---|---|---|---|---|
| 4,619,709 | A | 10/1986 | Fiocco | 134/22.14 |
| 4,711,256 | A | 12/1987 | Kaiser | 134/25.4 |
| 5,039,349 | A | 8/1991 | Schoeppel | 134/26 |
| 5,288,422 | A | 2/1994 | Basu et al. | 252/174 |
| 5,289,838 | A | 3/1994 | Odell | 134/166 R |
| 5,298,083 | A | 3/1994 | Van der Puy et al. | 134/42 |
| 5,350,458 | A | 9/1994 | Pinsl-Ober et al. | 134/22.1 |
| 5,397,398 | A | 3/1995 | Van Vlahakis et al. | 134/22.11 |
| 5,440,824 | A | 8/1995 | Ramachandran et al. | 34/443 |
| 5,520,837 | A | 5/1996 | Antin et al. | 252/135 |
| 6,048,832 | A | 4/2000 | Thenappan et al. | 510/410 |
| 6,110,885 | A | 8/2000 | Chan | 510/473 |

OTHER PUBLICATIONS

New Mexico State Library Catalog Index, p. 1 of 1.

email (2 pages) dated Jul. 31, 2002, from Reference Librarian, New Mexico State University Library, about Crowe thesis.

"Krytox performance lubricants", 5 pages obtained at the web site www.dupont.com on Feb. 13, 2000.

"3M HFEs (Hydrofluoroethers) For Aircraft Cleaning", 6 pages obtained at the web site www.3m.com on Mar. 12, 2000.

"Still Looking for a fluid you can live with?", 24 pages obtained at the web site www.3m.com on Mar. 12, 2000.

METHODS, COMPOSITIONS AND APPARATUS FOR CLEANING SURFACES

CROSS-REFERENCE TO RELATED APPLICATIONS

This application is a continuation of Ser. No. 09/775,641, filed Feb. 5, 2001, now abandoned, which claims benefit of Provisional Application 60/1 80,175, filed Feb. 4, 2000, and claims benefit of Provisional Application 60/185,691, filed Feb. 29, 2000, and claims benefit of Provisional Application 60/187,866, filed Mar. 8, 2000.

FIELD OF THE INVENTION

This invention relates to the field of cleaning the surfaces within vessels that have restricted points of entry, and in particular, the surfaces within oxygen converters and oxygen cylinders. These oxygen converters and oxygen cylinders are components of the onboard oxygen supply systems of aircraft. These oxygen cylinders may be high pressure or low pressure, and may be fixed or portable. The interior surfaces may be metal, including stainless steel. The restricted points of entry may prevent these surfaces from being cleaned by application of mechanical force or sonic energy. The contaminants to be cleaned from the surfaces include organic matter and particulates.

BACKGROUND OF THE INVENTION

The oxygen supply systems on aircraft may comprise oxygen converters, cylinders, lines, regulators, molecular sieve oxygen generators (MSOG units), and other apparatus. The cleaning of these oxygen supply systems is required primarily to remove two types of contamination. The first type of contamination arises from organic compounds. These organic compounds include jet fuel, compounds that result from the incomplete combustion of jet fuel, hydraulic oil and special types of greases that are used in these oxygen systems. The second type of contamination arises from particles of dust and dirt, as well as particles of Teflon that are found in the greases that may be used in these oxygen systems, and from Teflon tape which may be used in the threaded connections of these oxygen systems. The particulates may be in a size range of about one to 300 microns, and more commonly, in a size range of about 2 to about 150 microns.

One component of an aircraft oxygen supply system may be an oxygen converter. An oxygen converter may be a stainless steel sphere within a second stainless steel sphere. There is a vacuum seal between the inner sphere and the outer sphere. Oxygen converters are reservoirs that convert liquid oxygen to gaseous oxygen that may be breathed by the crew and passengers of the aircraft. At the present time, oxygen converters are typically constructed in volumes of 75 liters, 25 liters, 10 liters and 5 liters. The inner sphere of an oxygen converter typically has one small opening at the top, and a second small opening at the bottom. Each opening may be about 0.25 inch in diameter. Each line between the inner sphere and the outer sphere may not be straight, which may further restrict entry into the inner sphere. The opening at the top is used to vent the converter of gaseous oxygen. The opening at the bottom is used to repetitively input liquid oxygen into the converter and subsequently to output liquid oxygen from the converter. As the liquid oxygen exits the oxygen converter through the small opening at the bottom, it travels through a coil, and a pressure drop occurs that turns the liquid oxygen into gaseous oxygen. A harness is used to connect the oxygen converter to the oxygen lines in the aircraft.

The prior art cleaning of oxygen converters usually involved the removal of the oxygen converter from the aircraft. The oxygen converter was cut open, cleaned, and welded back together. Each cleaning resulted in a decrease in the size of the oxygen converter. This cleaning could be carried out only about two times because of the precise size requirements for oxygen converters. In some aircraft, recent experience is that a new oxygen converter may be in use for an average of seven years before the first cleaning. However, only three or four years pass before the second and final cleaning. The average service life of an oxygen converter may be less than fifteen years.

Prior attempts have been made to clean oxygen converters without cutting open the oxygen converter. Some attempts have involved the use of chlorofluorocarbons, and have generally had unsatisfactory results. Aqueous solvents are unacceptable because they are difficult to remove from converters, and residual water may freeze and create a dangerous buildup of pressure which may destroy the converter. Water may destroy the probe assembly within the converter.

There are certain requirements for methods, compositions and apparatus for cleaning the surfaces within aircraft oxygen supply systems to remove such contaminants. The methods should be able to be carried out in a relatively short period of time. Preferably, the cleaning should be carried out with the removal of a minimum amount of the components of the oxygen system from the aircraft. The cleaning compositions should be non-aqueous, non-flammable, non-toxic, and environmentally friendly. The solvent of the cleaning compositions should be able to be used as a verification fluid that is circulated through the cleaned components in order to verify cleaning. The cleaning should achieve at least a level B of ASTM standard G93-96, which may be stated as less than 3 mg/ft$^2$ (11 mg/m$^2$), or less than about 3 mg. of contaminants per square foot of interior surface of the components, or less than about 11 mg. of contaminants per square meter of interior surface of the components. The method of ASTM standard G93-96 may not accurately determine the level of cleanliness in vessels with restricted entry.

SUMMARY OF THE INVENTION

The present invention comprises methods, compositions and apparatus for cleaning surfaces, and particularly, cleaning the interior surfaces of oxygen converters and oxygen cylinders. These methods, compositions and apparatus have certain features in common, and other features that may be varied depending on the nature of the surfaces to be cleaned.

The present invention achieves the satisfactory cleaning of contaminants from oxygen converters without the need to cut the oxygen converter open, by using controlled flash boiling of the cleaning composition within the oxygen converter. The cleaning composition is both released into the oxygen converter, and maintained in the oxygen converter, at a temperature and pressure sufficient to maintain boiling. The pressure may be below ambient and the temperature above ambient, depending on the cleaning composition. The boiling provides agitation that achieves satisfactory cleaning. Adequate agitation cannot be provided by sonic energy or mechanical means due to the configuration of the oxygen converter.

The cleaning composition comprises a fluorocarbon solvent. In a preferred embodiment, the cleaning composition further comprises a fluorosurfactant. The boiling point of the fluorocarbon solvent should be sufficiently higher than the boiling point of the fluorosurfactant, to allow the removal of the fluorocarbon solvent from the mixture after the completion of the cleaning.

The apparatus for cleaning oxygen converters comprises a surfactant tank to store surfactant, and to provide surfactant to a surfactant proportioner. The surfactant proportioner stores a fixed amount of surfactant until it is flushed by solvent into a solution tank. A solvent tank is provided to store solvent, and to provide solvent to a solvent proportioner. The solvent proportioner stores a fixed volume of solvent, and delivers the fixed volume of solvent to the surfactant proportioner. The resulting mixture of solvent and surfactant is delivered to the solution tank. The solution tank delivers a fixed volume of solution to a pressure tank. The pressure tank is provided with heaters to increase the temperature and pressure of the solution. A vacuum pump creates a vacuum within a vacuum tank. The cleaning apparatus is attached to the oxygen converter which is to be cleaned. A valve between the oxygen converter and the vacuum tank is opened, and the gas within the oxygen converter is evacuated. The first valve is closed, and a second valve is opened between the pressure tank and the oxygen converter. The pressure differential between the evacuated oxygen converter and the pressure tank causes the heated, pressurized solution to flow from the pressure tank into the oxygen converter, and boil within the oxygen converter. After the oxygen converter is filled to the desired level with cleaning solution, the second valve is closed and the first valve between the oxygen converter and the vacuum tank is opened. The cleaning solution boils within the oxygen converter. After completion of a sufficient time period of boiling, the first valve is closed between the vacuum tank and the oxygen converter. The solution from the oxygen converter is then diverted to a distillation unit. In a preferred embodiment, dry air is introduced into the top of the oxygen converter while the solution exits from the bottom of the converter. The distillation unit distills solvent, which is returned to the solvent tank. The remaining surfactant and contaminants in the distillation unit are removed and disposed of. If required for sufficient cleaning, a single oxygen converter may be subjected to repetitions of the controlled flash boiling. After completion of the controlled flash boiling, the oxygen converter is rinsed with solvent, and then purged with dry air to remove the solvent.

The same methods, cleaning compositions and apparatus may be used to clean oxygen cylinders.

DETAILED DESCRIPTION OF THE INVENTION

Figure 1:
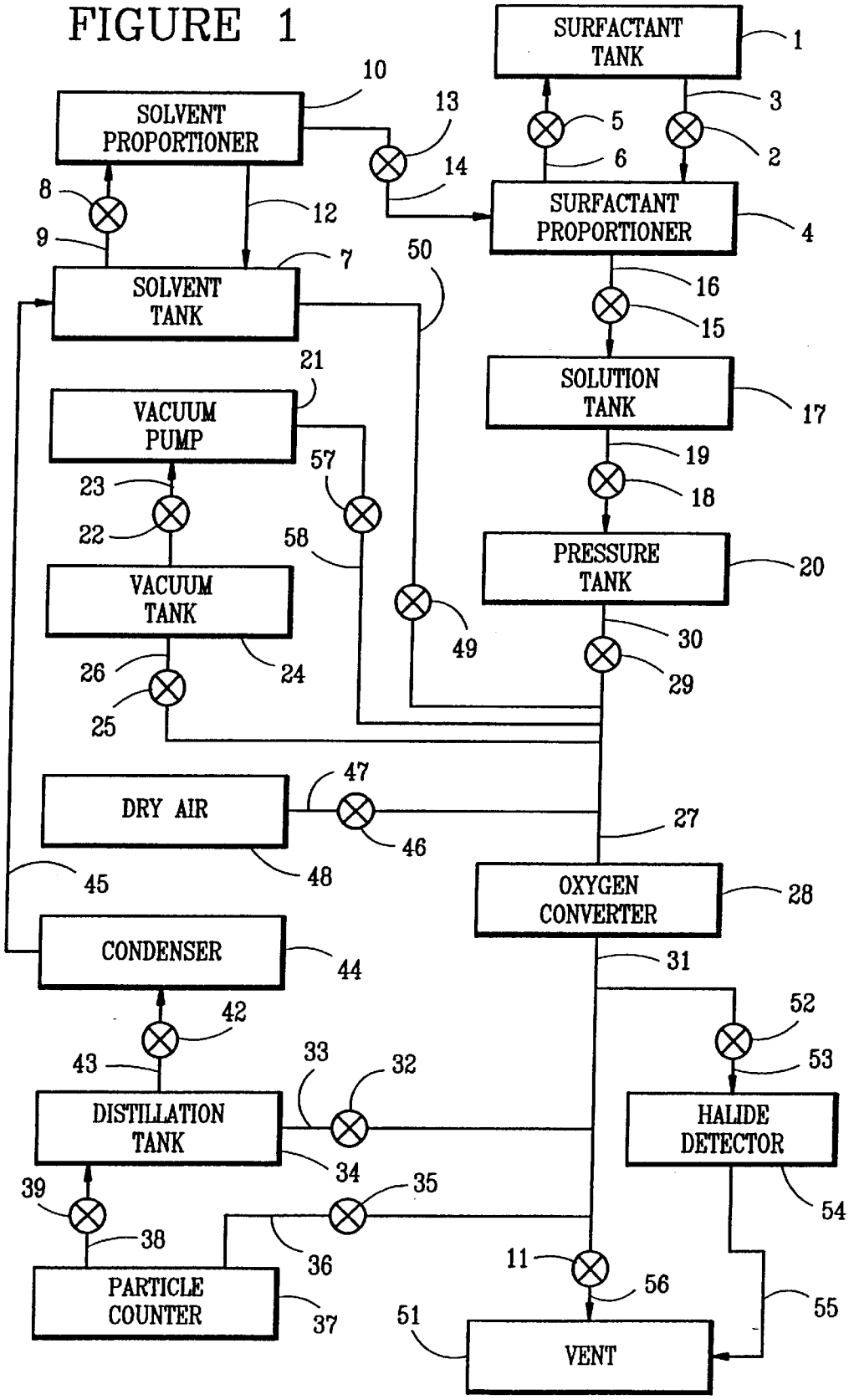
FIG. 1 is a schematic illustration of apparatus embodying the invention.

The method of the present invention may comprise five steps. The first step is the mixing of the surfactant and the solvent. The second step is the controlled flash boiling of the cleaning mixture within the oxygen converter or the oxygen cylinder. The third step is rinsing the oxygen converter or the oxygen cylinder with pure solvent. The fourth step is checking the rinse fluid to determine the level of contaminants. The fifth step is purging the oxygen converter or the oxygen cylinder with dry air to remove the remaining solvent.

The solvent may be selected from a number of fluorocarbons. The preferred solvent is HFE-7100, which is a mixture of methylnonafluorobutylether, Chemical Abstracts Service No. 163702-08-7, and methylnonafluoroisobutylether, Chemical Abstract Service No.163702-07-06. HFE-7100 generally comprises about 30–50 percent of methylnonafluorobutylether and about 50–70 percent of the methylnonafluoroisobutylether. A second solvent is FC-72, which is Chemical Abstract Service No. 865-42-1, and comprises a mixture of fluorinated compounds with six carbons. A third solvent is FC-77 which is Chemical Abstract Service No. 86508-42-1, and comprises a mixture of perfluorocompounds with 8 carbons.

The surfactant of the present invention may be selected from the following fluorosurfactants, or similar fluorosurfactants. The preferred surfactant, Krytox alcohol, is a nonionicfluorosurfactant, which comprises hexafluoropropylene oxide homopolymer. A second surfactant is Zonyl UR, which is an anionic fluorosurfactant. It comprises Telomer B phosphate, which is known by Chemical Abstracts Service No. 6550-61-2. A third surfactant is Krytox 157FS, which is a perfluoropolyether carboxylic acid, Chemical Abstracts Service No. 51798-33-5-100.

A preferred cleaning composition comprises from about 0.001% to about 5% by weight surfactant, and more preferably from about 0.01% to about 0.5% by weight surfactant. In a preferred embodiment, from about 0.05% to about 0.15% by weight of the surfactant Krytox alcohol in the solvent HFE-7100, is the cleaning composition of the present invention.

The methods and apparatus of the present invention are more fully disclosed in FIG. 1 and the following description.

In one embodiment of the invention, surfactant tank 1 is provided with a concentrated surfactant mixture comprising about 15% by weight of the surfactant Krytox alcohol in the solvent HFE-7100. Valve 2 in line 3 is opened, and valve 5 in return line 6 is opened. A pump (not shown) circulates concentrated surfactant through line 3, into surfactant proportioner 4, and back through line 6 to surfactant tank 1. Once surfactant proportioner 4 is full of concentrated surfactant, valve 2 and valve 5 are closed.

Solvent tank 7 is supplied with HFE-7100 solvent. Valve 8 in line 9 is opened. A pump (not shown) pumps solvent from solvent tank 7 to solvent proportioner 10. If excess solvent is inadvertently pumped to solvent proportioner 10, then it may return to solvent tank 7 through overflow line 12. A sensor (not shown) in solvent proportioner 10 detects when a predetermined amount of solvent has been pumped into solvent proportioner 10. In one embodiment of the invention, the predetermined amount is 25 liters of solvent. Once the predetermined level has been reached, valve 8 is closed.

Valve 13 in line 14 and valve 15 in line 16 are opened. A pump (not shown) pumps solvent from solvent proportioner 10 through line 14, through surfactant proportioner 4 and through line 16 into solution tank 17. This combines a predetermined amount of concentrated surfactant in surfactant proportioner 4 with a predetermined amount of solvent in solvent proportioner 10, to achieve the desired cleaning solution in solution tank 17. Valve 13 and valve 15 are then closed.

The foregoing steps of pumping a predetermined amount of surfactant into surfactant proportioner 4, pumping a predetermined amount of solvent into solvent proportioner 10, and subsequently pumping these predetermined amounts into solution tank 17, may be repeated until a predetermined amount of cleaning solution is achieved in solution tank 17.

In a preferred embodiment, surfactant tank 1, surfactant proportioner 4, solvent tank 7, solvent proportioner 10 and solution tank 17 are each constructed of stainless steel.

Valves may be constructed of brass or stainless steel. Lines are preferably constructed of stainless steel. Teflon fittings and valves should not be used because Teflon may swell on exposure to the solvent.

After a predetermined amount of cleaning solution is present in solution tank 17, valve 18 is opened. A pump (not shown) pumps cleaning solution from solution tank 17, through line 19, into pressure tank 20. Pressure tank 20 is provided with a plurality of immersion heaters. In a preferred embodiment, five immersion heaters are present in pressure tank 20. A level sensor (not shown) prevents the immersion heaters from heating unless the level of cleaning solution is above the immersion heaters. The immersion heaters heat the cleaning solution in pressure tank 20 to a temperature of about 70–90° C., and preferably about 80° C., which increases the pressure to about 30 psi in the pressure tank.

Vacuum pump 21 is activated, and valve 22 is opened. As the gas in vacuum tank 24 is evacuated through line 23 by vacuum pump 21, a vacuum in vacuum tank 24 is created. Vacuum tank 24 is capable of maintaining a vacuum of at least from about 23 to about 26 inches of mercury, and preferably at least about 15 inches of mercury, with valves 22 and 25 closed. Oxygen converter 28 is (or was previously) attached to the cleaning apparatus by lines 27 and 31 through a harness (not shown). The harness may comprise two six foot braided stainless steel lines with quick connects (not shown). With valve 25 closed, valve 22 is opened and vacuum pump 21 pulls a vacuum through line 23 on vacuum tank 24. When a predetermined level of evacuation of vacuum tank 24 is reached, valve 22 is closed. With all other valves to the oxygen converter closed, valve 57 is opened and vacuum pump 21 pulls a vacuum through line 58 on oxygen converter 28. When a predetermined level of evacuation of oxygen converter 28 is reached, valve 57 is closed. This results in a reduced pressure in oxygen converter 28, and said reduced pressure is less than atmospheric pressure. Subsequently, valve 29 is opened. Heated cleaning solution flows from pressure tank 20 through lines 30 and 27 into oxygen converter 28 and flashes to a boil within oxygen converter 28 because of the reduced pressure in oxygen converter 28. When the level of cleaning solution in oxygen converter 28 reaches a predetermined level, valve 29 is closed. This cycle of vacuum and pressure may be repeated. Valve 25 may be opened to begin a second cycle of vacuum and pressure. A vacuum is pulled on oxygen converter 28 through lines 27 and 26. When the level of cleaning solution in oxygen converter 28 is reduced to a predetermined level, valve 25 is closed. Subsequently, valve 29 is again opened. This cycling of vacuum and pressure causes continued boiling of the cleaning solution within oxygen converter 28. Vacuum tank 24 is provided with a water jacket to increase the pressure drop for the contents of vacuum tank 24, and thereby to condense any vapors that result from the boiling. Preferably, valves 22 and 57 are not opened while cleaning solution is in oxygen converter 28. In one embodiment of the invention, from about five to about twenty cycles, and preferably about ten cycles of vacuum and pressure are carried out on the oxygen converter before it is rinsed.

After the completion of a predetermined amount of boiling of the cleaning solution within oxygen converter 28, valves 25 and 29 are closed, and valve 46 is opened.

The cleaning solution is drained from oxygen converter 28 by opening valve 32. Dry air flows from dry air source 48 through lines 47 and 27 to the top of oxygen converter 28. Cleaning solution flows from the bottom of oxygen converter 28 through lines 31 and 33 to distillation tank 34. After the cleaning solution has been drained from oxygen converter 28, valves 32 and 46 are closed.

Oxygen converter 28 is then rinsed to remove any residual contaminants and surfactant. Valve 49 is opened, and solvent is pumped by a pump (not shown) from solvent tank 7 through lines 50 and 27 to the top of oxygen converter 28. After oxygen converter 28 is filled with solvent, valve 49 is closed, and valves 32, 35, 39 and 46 are opened. The solvent flows from oxygen converter 28 through lines 31 and 33 to distillation tank 34. At the same time, a portion of the solvent flows from oxygen converter 28 through lines 31 and 36 to particle counter 37, and subsequently through line 38 to distillation tank 34. Particle counter 37 measures the particles in the solvent and determines whether a predetermined level of cleanliness has been met. If the predetermined level of cleanliness has not been met, then another cycle of boiling may be initiated. Multiple cycles of boiling may be required to meet a predetermined level of cleanliness. However, in a preferred embodiment, a single cycle of boiling meets the predetermined level of cleanliness.

When the predetermined level of cleanliness has been achieved, valves 32 and 35 are closed, and valves 11 and 46 are opened. Hot, dry air is forced through lines 47 and 27 to oxygen converter 28, through oxygen converter 28, and through lines 31 and 56 to vent 51. After a fixed period of time, valve 52 is opened and a portion of the dry air exiting the bottom of oxygen converter 28 flows through lines 31 and 53, through halide detector 54, and through line 55 to vent 51. In one embodiment, the period of time is about thirty minutes. Halide detector 54 may be set to a predetermined level to detect whether any solvent is present in the air exiting from oxygen converter 28. The halide detector may be set for 500 ppm, and more preferably 1000 ppm of the solvent. When the level of the solvent in the air exiting oxygen converter 28 falls beneath a predetermined level, valves 46, 49 and 52 are closed. The cleaning of oxygen converter 28 has been completed, and oxygen converter 28 may be removed from the cleaning apparatus.

Solvent may be regenerated by opening valve 42 and heating distillation tank 34. Solvent vapors pass from distillation tank 34 through line 43 to condenser 44. Condenser 44 condenses solvent and the condensed solvent is returned by line 45 to solvent tank 7. Surfactants and contaminants may accumulate in the bottom of distillation tank 34. Periodically, the contaminants and surfactants are removed from distillation tank 34 for disposal.

In a preferred embodiment of the apparatus, pressure tank 20, vacuum tank 24, and distillation tank 34, are constructed of eight gauge stainless steel. Excluding the cylindrical vacuum tank, all of the other tanks are rectangular and may be reinforced to prevent flexing, in a preferred embodiment.

Variations of the invention may be envisioned by those skilled in the art.

We claim:

1. A method of cleaning an oxygen converter comprising the following steps:

evacuating an oxygen converter to achieve a reduced pressure within said oxygen converter, wherein said reduced pressure is less than atmospheric pressure;

supplying a cleaning composition to said oxygen converter, wherein said cleaning composition comprises a fluorocarbon solvent and a fluorosurfactant, and wherein said cleaning composition boils at said reduced pressure within said oxygen converter; and removing said cleaning composition from said oxygen converter thereby cleaning said oxygen converter.

2. The method of claim 1, further comprising the following steps before the aforesaid step of supplying a cleaning composition to said oxygen converter:

mixing said fluorocarbon solvent and said fluorosurfactant to make said cleaning composition; and heating said cleaning composition to a predetermined temperature and pressure.

3. The method of claim 1, wherein said step of supplying said cleaning composition further comprises said cleaning composition at a temperature of about 80° C., and at a pressure of about 30 psi.

4. The method of claim 1, wherein said reduced pressure is at least about 15 inches of mercury.

5. The method of claim 2, further comprising the following steps after the aforesaid step of removing said cleaning composition from said oxygen converter:

rinsing said oxygen converter with said fluorocarbon solvent; and measuring said fluorocarbon solvent exiting from said oxygen converter to determine a level of particles therein; and evaporating said remaining fluorocarbon solvent in said oxygen converter by forcing dry air through said oxygen converter; and measuring said dry air exiting from said oxygen converter to determine the level of said fluorocarbon solvent therein.

6. The method of claim 2, wherein said mixing further comprises a predetermined amount of said fluorocarbon solvent and a predetermined amount of said fluorosurfactant.

7. The method of claim 5, further comprising a step of determining whether a predetermined level of cleanliness is met by said level of particles therein.

8. The method of claim 6, wherein said step of supplying said cleaning composition further comprises said cleaning composition at a temperature of about 80° C., and at a pressure of about 30 psi.

9. The method of claim 7, wherein said step of supplying said cleaning composition further comprises said cleaning composition at a temperature of about 80° C., and at a pressure of about 30 psi.

10. The method of claim 9, wherein said reduced pressure is at least about 15 inches of mercury.

11. A method of cleaning an oxygen cylinder comprising the following steps:

evacuating an oxygen cylinder to achieve a reduced pressure within said oxygen cylinder, wherein said reduced pressure is less than atmospheric pressure;

supplying a cleaning composition to said oxygen cylinder, wherein said cleaning composition comprises a fluorocarbon solvent and a fluorosurfactant, and wherein said cleaning composition boils at said reduced pressure within said oxygen cylinder; and removing said cleaning composition from said oxygen cylinder thereby cleaning said oxygen cylinder.

12. The method of claim 11, further comprising the following steps before the aforesaid step of supplying a cleaning composition to said oxygen cylinder:

mixing said fluorocarbon solvent and said fluorosurfactant to make said cleaning composition; and heating said cleaning composition to a predetermined temperature and pressure.

13. The method of claim 11, wherein said step of supplying said cleaning composition further comprises said cleaning composition at a temperature of about 80° C., and at a pressure of about 30 psi.

14. The method of claim 11, wherein said reduced pressure is at least about 15 inches of mercury.

15. The method of claim 12, further comprising the following steps after the aforesaid step of removing said cleaning composition from said oxygen cylinder:

rinsing said oxygen cylinder with said fluorocarbon solvent; and measuring said fluorocarbon solvent exiting from said oxygen cylinder to determine a level of particles therein; and evaporating said remaining fluorocarbon solvent in said oxygen cylinder by forcing dry air through said oxygen cylinder; and measuring said dry air exiting from said oxygen cylinder to determine the level of said fluorocarbon solvent therein.

16. The method of claim 12, wherein said mixing further comprises a predetermined amount of said fluorocarbon solvent and a predetermined amount of said fluorosurfactant.

17. The method of claim 15, further comprising a step of determining whether a predetermined level of cleanliness is met by said level of particles therein.

18. The method of claim 16, wherein said step of supplying said cleaning composition further comprises said cleaning composition at a temperature of about 80° C., and at a pressure of about 30 psi.

19. The method of claim 17, wherein said step of supplying said cleaning composition further comprises said cleaning composition at a temperature of about 80° C., and at a pressure of about 30 psi.

20. The method of claim 19, wherein said reduced pressure is at least about 15 inches of mercury.

* * * * *